US007680443B2

(12) United States Patent
Murayama et al.

(10) Patent No.: US 7,680,443 B2
(45) Date of Patent: Mar. 16, 2010

(54) DEVELOPING DEVICE INCLUDING AN ADVANCE IMPEDING MEMBER AND AN IMAGE FORMING APPARATUS USING THE SAME

(75) Inventors: Shin Murayama, Hyougo (JP); Shuuichi Nakagawa, Ohsaka (JP); Ryuji Inoue, Hyougo (JP); Shintaro Yamada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 303 days.

(21) Appl. No.: 11/673,221

(22) Filed: Feb. 9, 2007

(65) Prior Publication Data

US 2007/0189812 A1 Aug. 16, 2007

(30) Foreign Application Priority Data

Feb. 15, 2006 (JP) ..... 2006-037745

(51) Int. Cl.
*G03G 15/08* (2006.01)

(52) U.S. Cl. ..... 399/258

(58) Field of Classification Search ..... 399/258, 399/262, 27, 281, 119, 260
See application file for complete search history.

(56) References Cited

U.S. PATENT DOCUMENTS

| | | | | |
|---|---|---|---|---|
| 6,480,692 | B2 * | 11/2002 | Yamazaki et al. | 399/281 |
| 7,187,876 | B2 * | 3/2007 | Ito et al. | 399/27 |
| 2004/0190938 | A1 * | 9/2004 | Horinoe et al. | 399/119 |

FOREIGN PATENT DOCUMENTS

| | | |
|---|---|---|
| JP | 60-218679 | 11/1985 |
| JP | 10-20640 | 1/1998 |
| JP | 10-39612 | 2/1998 |
| JP | 10-142917 | 5/1998 |
| JP | 11-167282 | 6/1999 |
| JP | 2001-194883 | 7/2001 |
| JP | 2003-57935 | 2/2003 |

OTHER PUBLICATIONS

U.S. Appl. No. 11/924,994, filed Oct. 26, 2007, Katoh, et al.
U.S. Appl. No. 11/947,369, filed Nov. 29, 2007, Inoue, et al.
U.S. Appl. No. 11/965,198, filed Dec. 27, 2007, Murayama, et al.
U.S. Appl. No. 12/179,038, filed Jul. 24, 2008, Murayama, et al.

* cited by examiner

*Primary Examiner*—Quana M Grainger
(74) *Attorney, Agent, or Firm*—Oblon, Spivak, McClelland, Maier & Neustadt, L.L.P.

(57) ABSTRACT

A developing device is provided with which the increase in torque of a supply roller, unevenness of image density, and wear to the supply roller caused by the formation of an aggregated block of toner in the gap between the supply roller and the opposing side wall of a supply developer holding chamber can be suppressed. This developing device comprises a developing roller for developing an electrostatic latent image supported on a photoconductive member, a supply developer holding chamber for holding toner to be supplied to the developing roller, a supply roller for supplying the toner supported on the peripheral face thereof to the developing roller, a hopper that is disposed above the supply developer holding chamber and used to hold toner for replenishing the supply developer holding chamber, and a communication opening for allowing the hopper to communicate with the supply agent holding chamber, wherein a canopy member is provided directly above the gap to impede the advance of the toner on the supply roller into the gap between the supply roller and the opposing side wall of the supply developer holding chamber.

18 Claims, 6 Drawing Sheets

FIG. 3

| DISTANCE BETWEEN CANOPY MEMBER AND SUPPLY ROLLER (mm) | TONER AGGREGATION IN GAP BETWEEN SUPPLY ROLLER AND OPPOSING SIDE WALL |
|---|---|
| 0 | YES |
| 1 | NO |
| 2 | NO |
| 3 | NO |
| 4 | NO |
| 5 | YES |

DEVELOPING DEVICE INCLUDING AN ADVANCE IMPEDING MEMBER AND AN IMAGE FORMING APPARATUS USING THE SAME

BACKGROUND OF THE INVENTION

1. Field of the Invention

The present invention relates to a developing method in which a latent image on a latent image support is developed by a developer support that supports a developer supplied from a developer supplier, and to a developing device, a process unit, an image forming apparatus, and an image forming method in which this developing method is employed.

2. Description of the Related Art

With a developing device of this type, if a large amount of toner (developer) is deposited on a developer supply member such as a supply roller, the pressure produced by the toner's own weight promotes aggregation of the toner, which leads to inferior image quality and various other problems. This problem has generally been dealt with by providing a second holding chamber for holding a large quantity of toner to the side of and apart from a first holding chamber for holding the developer supplier and toner, and gradually supplying the proper amount of toner from the second holding chamber to the first holding chamber, so that the aggregation of the toner is minimized around the developer supply member. Aggregation of the toner inside the second holding chamber holding a large amount of toner is minimized by stirring the toner with a rotary stirring member such as an agitator, and thereby mixing the toner with air.

Meanwhile, a so-called tandem configuration is often used in recent color image forming apparatus in order to increase the printing speed. With a tandem system, a latent image support (such as a photoconductive member) is combined with a developing device for developing a latent image supported on the surface of this support, a plurality of these combinations are lined up, and monocolor images of mutually different colors that have been developed on this photoconductive member are superposed and transferred to an intermediate transfer belt or the like. This superposed transfer forms a multicolor image (such as a full-color image). With a configuration such as this, if the combinations of latent image support and developing device are lined up horizontally, and the developing device is one in which the above-mentioned second holding chamber is disposed to the side of the first holding chamber, then a corresponding amount of space has to be left in the horizontal direction, and this ends up making the apparatus larger.

However, this increase in the size of the apparatus can be suppressed by using a taller developing device, such as the one disclosed in Japanese Laid-Open Patent Application 2001194883. This developing device has a hopper serving as a second holding chamber above a first holding chamber that encloses toner and a supply roller serving as a developer supply member. The toner in the hopper passes through a communicating passage provided between the hopper and the first holding chamber, and drops into the first holding chamber. In the first holding chamber, the supply roller, which supports toner around its peripheral face, is rotated to supply the toner on the supply roller to a developing roller serving as a developer support member. With this configuration, the second holding chamber, which takes up a particularly large amount of space in a developing device, is provided above the first holding chamber, so that the developing device has an overall shape that is taller and takes up more space in the vertical direction than in the horizontal direction, which means that the increase in space taken up in the horizontal direction can be minimized.

With a developing device with this configuration, however, a large amount of the toner that drops down from the hopper into the first holding chamber is deposited on the supply roller. The pressure produced by the toner's own weight causes the particles to aggregate, which can increase the torque of the supply roller, lead to uneven image density, or severely abrade the supply roller.

Experiments conducted by the inventors have revealed that the aggregation of toner within a tall developing device occurs most markedly between the supply roller and the opposing side wall which, out of the plurality of side walls of the first holding chamber, opposes the peripheral face of the supply roller via a relatively small gap. More specifically, with a tall configuration as with the developing device described in Japanese Laid-Open Patent Application 2001-194883, After the toner deposited on the supply roller has been supported on the surface of the supply roller, it is transported by the rotation of the roller to the supply location, which is either in contact with or across from the supply roller. Then the surface of the supply roller that has passed the supply location is advanced by its rotation back to a contact location with the deposited toner. In the space around the supply roller region, from the supply location to the contact location, if the toner should spread out laterally or move in the gravitational direction under its own weight, it will not be able to come into proper contact with the supply roller, and will end up staying where it is indefinitely. Therefore, if the above-mentioned space is ensured, this will increase the amount of wasted toner that is not used in developing.

In view of this, with a tall developing device, it is preferable for there to be as little wasted toner as possible, which is accomplished by moving the opposing side wall of the first holding chamber considerably closer to the supply roller region, from after the supply roller has passed the above-mentioned supply location up to the contact location. The developing device described in Japanese Laid-Open Patent Application 2001-194883 and the tall developing device used in the experiments conducted by the inventors both had this configuration.

Nevertheless, with this configuration, if toner that has dropped down from the hopper into the first holding chamber and been deposited on the supply roller is subjected to higher pressure due to the increase in the deposited amount, or is pressed against the toner in the hopper, it may work its way in between the supply roller and the opposing side wall of the first holding chamber. This toner that has worked its way in can bind movement within this small space, and is difficult to dislodge from the gap. Meanwhile, toner deposited on the supply roller readily works its way into this gap, so the pressure of the toner in the gap steadily builds, until the toner finally becomes an aggregated block. When this aggregated block presses against the supply roller, it raises the torque of the supply roller, increases image density unevenness, and leads to abrasion of the supply roller.

A toner that contains wax in its particles has often been used in recent years in an effort to achieve oilless fixing OR low-temperature fixing, but such toner is relatively soft, and the adhesion between particles is relatively strong, so this toner is prone to forming an aggregated block, which makes the problems mentioned above more likely to occur.

Technologies relating to the present invention are also disclosed in, e.g., Japanese Laid-Open Patent Applications S60-218679, H10-020640, H10-039612, and H11-167282.

SUMMARY OF THE INVENTION

It is an object of the present invention to provide a developing method, and a developing device, process unit, image forming apparatus, and image forming method in which this developing method is employed. The size of the apparatus can be reduced when a tandem system is employed, and the increase in torque of the developer supply member, unevenness of image density, and wear to the developer supply member caused by the formation of an aggregated block of developer in the gap between the developer supply member and the opposing side wall of the first holding chamber can be suppressed.

In an aspect of the present invention, a developing device comprises a developer support member for developing a latent image supported on a latent image support with a developer supported on a surface of the developer support member; a first holding chamber for holding a developer to be supplied to the developer support member; a developer supply member for supplying the developer supported on a peripheral face thereof to the developer support member due to rotation within the first holding chamber; a second holding chamber, disposed above the first holding chamber, for holding a developer for replenishing the first holding chamber; a communication opening provided between the two chambers for allowing the developer inside the second holding chamber to drop down into the first holding chamber; an opposing side wall which, of a developer supply member peripheral face region extending from a location where the developer is supplied to the developer supply member up to where the peripheral face is moved to a location where the developer that has dropped through the communication opening into the first holding chamber is supported, opposes, via a predetermined gap, at least a region just ahead of advance of the developer to the location where the developer is supported; and an advance impeding member for impeding the advance of the developer that has dropped through the communication opening into the first holding chamber, into the gap.

In another aspect of the present invention, a process unit is used in an image forming apparatus comprising a latent image support for supporting a latent image and a developing means for developing the latent image on the latent image support. At least the latent image support and the developing means form a single unit which is supported on a supply support member and can be mounted to and removed from an image forming apparatus main body. The developing means comprises a developer support member for developing a latent image supported on a latent image support with a developer supported on a surface of the developer support member; a first holding chamber for holding a developer to be supplied to the developer support member; a developer supply member for supplying the developer supported on a peripheral face thereof to the developer support member due to rotation within the first holding chamber; a second holding chamber, disposed above the first holding chamber, for holding a developer for replenishing the first holding chamber; a communication opening provided between the two chambers for allowing the developer inside the second holding chamber to drop down into the first holding chamber; an opposing side wall which, of a developer supply member peripheral face region extending from a location where the developer is supplied to the developer supply member up to where the peripheral face is moved to a location where the developer that has dropped through the communication opening into the first holding chamber is supported, opposes, via a predetermined gap, at least a region just ahead of advance of the developer to the location where the developer is supported; and an advance impeding member for impeding the advance of the developer that has dropped through the communication opening into the first holding chamber, into the gap.

In another aspect of the present invention, an image forming apparatus comprises a latent image support for supporting a latent image; and developing means for developing the latent image on the latent image support. The developing means comprises a developer support member for developing a latent image supported on a latent image support with a developer supported on a surface of the developer support member; a first holding chamber for holding a developer to be supplied to the developer support member; a developer supply member for supplying the developer supported on a peripheral face thereof to the developer support member due to rotation within the first holding chamber; a second holding chamber, disposed above the first holding chamber, for holding a developer for replenishing the first holding chamber; a communication opening provided between the two chambers for allowing the developer inside the second holding chamber to drop down into the first holding chamber; an opposing side wall which, of a developer supply member peripheral face region extending from a location where the developer is supplied to the developer supply member up to where the peripheral face is moved to a location where the developer that has dropped through the communication opening into the first holding chamber is supported, opposes, via a predetermined gap, at least a region just ahead of advance of the developer to the location where the developer is supported; and an advance impeding member for impeding the advance of the developer that has dropped through the communication opening into the first holding chamber, into the gap.

In another aspect of the present invention, a developing method comprises the steps of rotating a developer supply member opposing, via a predetermined gap, any one of a plurality of opposing side walls in a first holding chamber for holding a developer to be supplied to a developer support member, and thereby supplying the developer from the developer supply member to the developer support member; using the developer supported on the surface of the developer support member to develop a latent image supported on a latent image support; dropping the developer held in a second holding chamber disposed above the first holding chamber, through a communication opening between the second holding chamber and the first holding chamber, toward the developer supply member in the first holding chamber, and thereby replenishing the first holding chamber with the developer; and providing as the first holding chamber an opposing side wall which, of a peripheral face region of the developer supply member extending from a location where the developer is supplied to the developer supply member up to where the peripheral face is moved to a location where the developer that has dropped through the communication opening into the first holding chamber is supported, opposes, via a predetermined gap, at least the region just ahead of advance of the developer to the location where the developer is supported, and impeding the advance, into the gap, of the developer that drops through the communication opening toward the developer supply member, by means of an advance impeding member provided directly above the gap.

In another aspect of the present invention, in an image forming method, a visible image is formed by performing a latent image formation step of forming a latent image on a latent image support, and a developing step of developing the latent image on the latent image support. The developing step comprises the steps of rotating a developer supply member in a first holding chamber for holding a developer to be supplied to a developer support member, and thereby supplying the developer from the developer supply member to the developer support member; using the developer supported on a surface of the developer support member to develop a latent image supported on a latent image support; dropping the developer held in a second holding chamber disposed above the first holding chamber, through a communication opening between the second holding chamber and the first holding chamber, toward the developer supply member in the first holding chamber, and thereby replenishing the first holding chamber with the developer; and by providing as the first holding chamber an opposing side wall which, of a developer supply member peripheral face region extending from a location where the developer is supplied to the developer supply member up to where the peripheral face is moved to a location where the developer that has dropped through the communication opening into the first holding chamber is supported, opposes, via a specific gap, at least the region just ahead of advance of the developer to the location where the developer is supported, and impeding the advance, into the gap, of the developer that drops through the communication opening toward the developer supply member, by means of an advance impeding member provided directly above the gap.

BRIEF DESCRIPTION OF THE DRAWINGS

The above and other objects, features, and advantages of the present invention will become more apparent from the following detailed description taken wit the accompanying drawings, in which:

FIG. 3 is a table of the relationship between the distance between a canopy member and a supply roller, and the toner aggregation in a gap between the supply roller and the opposing side wall;

DESCRIPTION OF THE PREFERRED EMBODIMENTS

An embodiment of an electrophotographic printer (hereinafter referred to simply as a printer) will now be described as an example of an image forming apparatus to which the present invention is applied.

First, the basic structure of this printer will be described.

Figure 1:
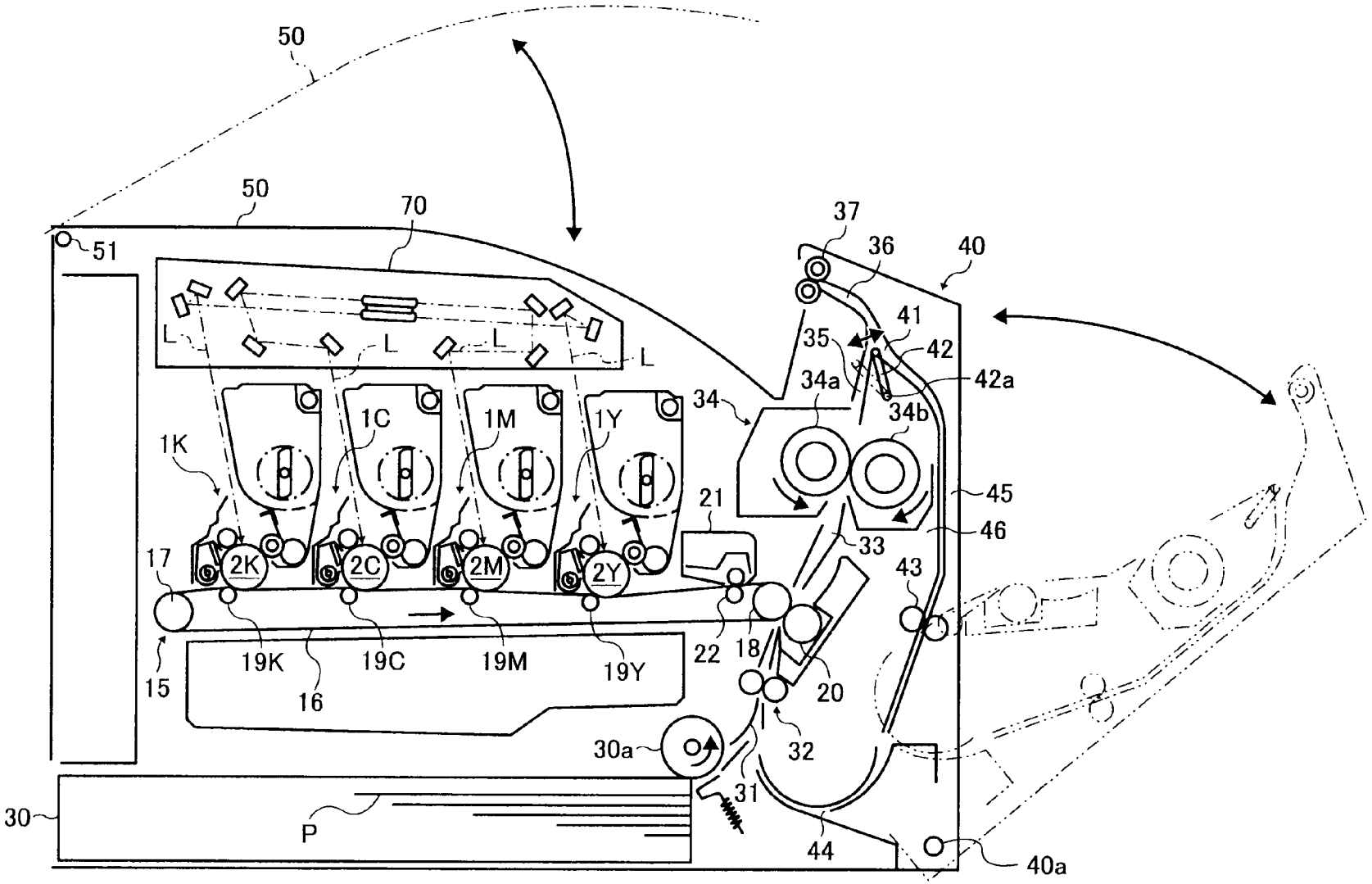
FIG. 1 is a diagram of the simplified structure of a printer pertaining to an embodiment of the present invention.
Figure 2:
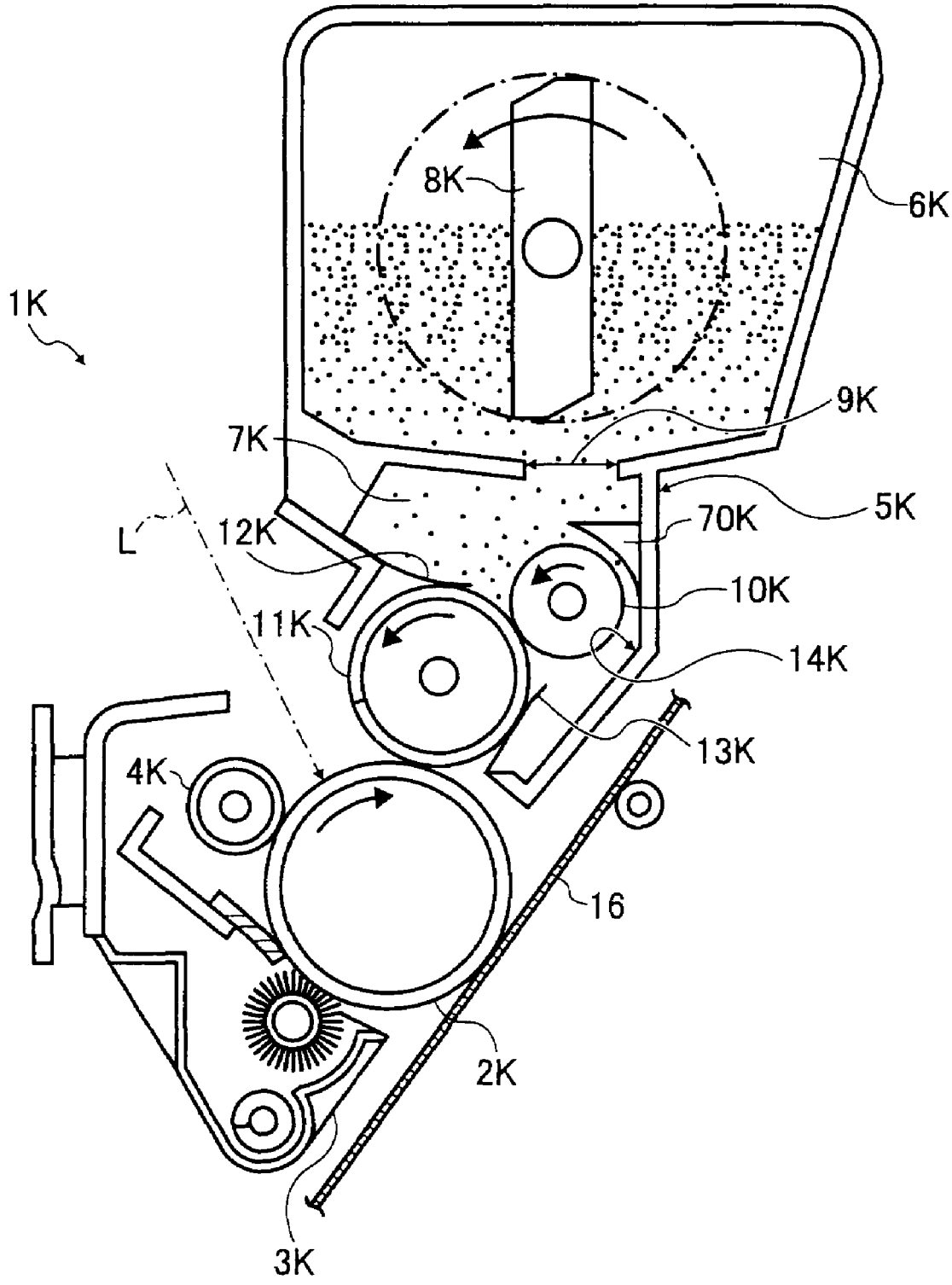
FIG. 2 is a diagram of the structure of a K process unit in the same printer.

FIG. 1 shows the simplified structure of this printer. In FIG. 1, this printer is equipped with four process units 1Y, 1M, 1C, and 1K for forming yellow, magenta, cyan, and black (hereinafter referred to as Y, M, C, and K) toner images. These use toners of mutually different colors (Y, M, C, and K) as the developer, but otherwise have the same structure, and are replaced at the end of their service life. To use the process unit 1K for forming a K toner image as an example, as shown in FIG. 2, this unit comprises a drum-shaped photoconductive member 2K serving as a latent image support, a drum cleaning apparatus 3K, a static eliminator (not shown), a charging roller 4K, a developing device 5K, and so forth. The process unit 1K can be mounted in and removed from the printer main body, allowing consumable parts to be replaced all at once.

The photoconductive member 2K is rotationally driven by a drive means (not shown) at a linear velocity of 150 mm/sec in the clockwise direction in the drawing. A high voltage is applied to the charging roller 4K by a high-voltage power supply circuit (not shown). Electrical discharge from the charging roller 4K toward the photoconductive member 2K is performed in the opposing area between the rotating photoconductive member 2K and the charging roller 4K. This discharge causes the surface of the photoconductive member 2K to be evenly charged to −500 V. This surface is then exposed to and scanned with a light beam L to support a K-use electrostatic latent image.

This K-use electrostatic latent image is developed into a K toner image by the developing device 5K that uses K toner (not shown). This latent image is then transferred onto an intermediate transfer belt 16 (discussed below). The drum cleaning apparatus 3K scrapes the surface of the photoconductive member 2K with a cleaning brush or cleaning blade to remove any residual toner adhering to the surface of the photoconductive member 2K after the intermediate transfer step.

The above-mentioned static eliminator removes any residual charge from the photoconductive member 2K after cleaning. This initializes the surface of the photoconductive member 2K is preparation for the following image formation. Similarly, with the other color process units (1Y, 1M, and 1C), toner images (Y, M, and C) are formed on photoconductive members (2Y, 2M, and 2C) and transferred onto the intermediate transfer belt 16 discussed below.

The above-mentioned developing device 5K has a tall hopper 6K that holds K toner (not shown), and a supply component 7K disposed under the hopper 6K. The hopper 6K, which serves as the second holding chamber, encloses an agitator 8K that is rotationally driven by a drive means (not shown), and toner for replenishing the supply component 7K, which serves as the first holding chamber.

The hopper 6K and the supply component 7K disposed under it communicate with each other through a communication opening 9K. The toner agitated by the agitator 8K in the hopper 6K is mixed with air to improve its fluidity, while dropping down through this communication opening 9K and into the supply component 7K. This replenishes the supply component 7K with toner from inside the hopper 6K.

A supply roller 10K (serving as the developer supply member) and toner are enclosed within the supply component 7K. Toner that drops out of the hopper 6K and into the supply component 7K is deposited on the supply roller 10K. The supply roller 10K is rotationally driven in the counter-clockwise direction in the drawing by a drive means (not shown).

A developing roller 11K, which serves as the developer support member, is disposed under the supply roller 10K. This developing roller 11K comes into contact with the supply roller 10K and the photoconductive member 2K while being rotationally driven in the counter-clockwise direction in the drawing by a drive means (not shown).

A developing bias (discussed below) is applied to the developing roller 11K by a power supply circuit (not shown). Meanwhile, a supply bias is applied to the supply roller 10K by a power supply circuit (not shown). The relationship between the developing bias and the supply bias forms an electrical field with which the negatively charged toner can be electrostatically moved from the supply roller 10K side toward the developing roller 11K side. The orientation of the electrical field is not limited to this, though, and, depending on the type of toner, may be the opposite orientation, or may be a zero direction so that the toner is not electrostatically moved between the rollers.

The toner deposited on the supply roller 10K is supported on the surface of the supply roller 10K. As the supply roller 10K rotates, it is carried to a place where the supply roller 10K and the developing roller 11K come into contact, and is transferred to the surface of the developing roller 11K by the above-mentioned electrical field or the effect of the pressure at the contact site. This transfer causes the toner supported on the surface of the developing roller 11K to move as the developing roller 11K rotates, and pass through the place where the developing roller 11K comes into contact with a thinning blade 12K.

A charge supplementing bias is applied to the thinning blade 12K by a power supply circuit (not shown). The relationship between this charge supplementing bias and the above-mentioned developing bias forms an electrical field with which the negatively charged toner can be electrostatically moved from the blade side toward the developing roller 11K side. Once the toner has advanced to the place where the developing roller 11K and the thinning blade 12K come into contact, it is pushed by this electrical field toward the developing roller 11K, while rubbing against the thinning blade 12K as the roller rotates, and this supplements frictional charging. At the same time, the layer thickness on the developing roller 11K is restricted.

Once the toner has passed through the place where the developing roller 11K and the thinning blade 12K come into contact, it is carried by the rotation of the developing roller 11K to a developing nip where the developing roller 11K and the photoconductive member 2K come into contact. The potential of the electrostatic latent image of the photoconductive member 2K, the potential of the background part of the photoconductive member 2K (uniform charge potential), and the developing bias are in the following relationship. The toner present between the developing roller 11K and the electrostatic latent image in the developing nip is electrostatically moved from the developing roller 11K side toward the electrostatic latent image side, whereas the toner present between the background part and the developing roller 11K is electrostatically moved from the background side toward the developing roller 11K side. The result of this relationship is that in the developing nip, the toner on the surface of the developing roller 11K is selectively transferred to the electrostatic latent image of the photoconductive member 2K. This transfer results in the electrostatic latent image being developed into a K toner image.

The surface of the supply roller 10K is composed of a foamed material that has a cell structure and is adjusted to an electrical resistance of $10^3$ to $10^{14}\Omega$, and toner transport efficiency is improved by incorporating the toner into these cells. Another function of these cells is to suppress toner deterioration during pressure concentration at the point of contact with the developing roller 11K.

A surface layer composed of an elastic rubber that exhibits frictional charging characteristics that are opposite those of the toner is formed on the surface of the developing roller 11K. This surface layer is adjusted to a JIS A hardness of 50° or less, and is adjusted to a surface hardness Ra of 0.2 to 2.0 μm. The result of a surface layer with these characteristics is that a toner image of uniform thickness is formed on the surface of the developing roller 11K.

The thinning blade 12K is composed of SUS 304 CSP, SUS 301 CSP, phosphor bronze, or another such metal, and is pressed toward the developing roller 11K at a pressing force of 10 to 100 N/m.

The casing of the supply component 7K supports a sealing film 13K in cantilever fashion, and the free end of this sealing film 13K is in contact with the developing roller 11K. This sealing film 13K and the above-mentioned thinning blade 12K separate the supply component 7K from the space in which the developing roller 11K is held, and prevent the toner from leaking out of the supply component 7K.

The K process unit here was described through reference to FIG. 2, but Y, M, and C toner images are formed on the surfaces of the photoconductive members 2Y, 2M, and 2C by the same process with the Y, M, and C process units 1Y, 1M, and 1C.

In FIG. 1 discussed above, an optical writing unit 70 is disposed above (in the vertical direction) the process units 1Y, 1M, 1C, and 1K. The optical writing unit 70, which serves as a latent image writing device, optically scans the photoconductive members 2Y, 2M, 2C, and 2K in the process units 1Y, 1M, 1C, and 1K with a light beam L emitted from a laser diode or LED on the basis of image information. This optical scanning forms Y, M, C, and K electrostatic latent images on the photoconductive members photoconductive members 2Y, 2M, 2C, and 2K. The optical writing unit 70 also illuminates the photoconductive members via a plurality of optical lenses or mirrors while polarizing the light beam L emitted from a light source, in the main scanning direction with a polygon mirror rotationally driven by a polygon motor (not shown).

An endless intermediate transfer belt 16 is installed under (in the vertical direction) the process units 1Y, 1M, 1C, and 1K, and a transfer unit 15 that endlessly moves in the counter-clockwise direction in the drawing is also installed. In addition to the intermediate transfer belt 16, the transfer unit 15 (serving as a transfer means) is also equipped with a drive roller 17, a driven roller 18, four primary transfer rollers 19Y, 19M, 19C, and 19K, a secondary transfer roller 20, a belt cleaning apparatus 21, a cleaning back-up roller 22, and so forth.

The intermediate transfer belt 16 is tensioned by the drive roller 17, the driven roller 18, the cleaning back-up roller 22, and the four primary transfer rollers 19Y, 19M, 19C, and 19K disposed on the inside of its loop, and is endlessly moved in the in the counter-clockwise direction in the drawing by the rotational force of the drive roller 17, which is rotationally driven in this same direction by a drive means (not shown).

The four primary transfer rollers 19Y, 19M, 19C, and 19K sandwich this endless moving intermediate transfer belt 16 between themselves and the photoconductive members 2Y, 2M, 2C, and 2K. As a result, Y, M, C, and K primary transfer nips are formed when the outer side of the intermediate transfer belt 16 comes into contact with the photoconductive members 2Y, 2M, 2C, and 2K.

A primary transfer bias is applied by a transfer bias power supply (not shown) to each of the primary transfer rollers 19Y, 19M, 19C, and 19K, and this forms an transfer electrical field between the electrostatic latent images on the photoconductive members 2Y, 2M, 2C, and 2K and the primary transfer rollers 19Y, 19M, 19C, and 19K. Transfer chargers, transfer brushes, or the like may be employed instead of the primary transfer rollers 19Y, 19M, 19C, and 19K.

When the Y toner formed on the surface of the photoconductive member 2Y of the Y-use process unit 1Y advances to the above-mentioned Y-use primary transfer nip along with the rotation of the photoconductive member 2Y, the action of the transfer electrical field and the nip pressure results in primary transfer from the photoconductive member 2Y onto the intermediate transfer belt 16. As the intermediate transfer belt 16 onto which a Y toner image has thus been primarily transferred passes through the M, C, and K primary transfer nips along with its endless movement, the M, C, and K toner images on the photoconductive members 2M, 2C, and 2K undergo primary transfer and are superposed, in order, over the Y toner image. This superposed primary transfer forms a four-color toner image on the intermediate transfer belt 16.

The secondary transfer roller 20 of the transfer unit 15 is disposed outside the loop of the intermediate transfer belt 16, and sandwiches the intermediate transfer belt 16 between itself and the driven roller 18 on the inside of the loop. As a result, a secondary transfer nip is formed when the outer side of the intermediate transfer belt 16 comes into contact with the secondary transfer roller 20. A secondary transfer bias is applied to the secondary transfer roller 20 by a transfer bias power supply (not shown). This forms a secondary transfer electrical field between the secondary transfer roller 20 and a grounded driven roller.

A paper feed cassette 30, which holds a stack of a plurality of sheets of recording paper P, is disposed under (in the vertical direction) the transfer unit 15, and is slid in and out of the casing of a printer. This paper feed cassette 30 is designed such that a paper feed roller 30*a* comes into contact with the top sheet of recording paper P in the stack, and this roller is rotated in the counter-clockwise direction in the drawing at a specific timing, causing the recording paper P to be fed out toward a paper feed path 31.

A pair of resist rollers 32 are disposed near the end of the paper feed path 31. These resist rollers 32 immediately stop rotating when the recording paper P fed out from the paper feed cassette 30 is sandwiched between these rollers. The rotational drive is restarted and the recording paper P is fed out toward the secondary transfer nip at a timing such that the sandwiched recording paper P can be synchronized to the four-color toner image on the intermediate transfer belt 16 in the above-mentioned secondary transfer nip.

The four-color toner image on the intermediate transfer belt 16 that has been tightly pressed against the recording paper P in the secondary transfer nip is secondarily transferred all at once onto the recording paper P under the influence of the secondary transfer electrical field or the nip pressure, and combines with the white color of the recording paper P to produce full-color toner image. Once the full-color toner image has thus been formed on its surface, the recording paper P passes through the secondary transfer nip and self-strips from the secondary transfer roller 20 and the intermediate transfer belt 16. It then goes along a post-transfer conveyance path 33 and is fed into a fixing device 34 (discussed below).

Residual toner that was not transferred to the recording paper P adheres to the intermediate transfer belt 16 after it passes through the secondary transfer nip. This residue is removed from the belt surface by a belt cleaning apparatus 21 that is in contact with the outer side of the intermediate transfer belt 16. A cleaning back-up roller 22 disposed inside the loop of the intermediate transfer belt 16 backs up the cleaning of the belt by the belt cleaning apparatus 21 from the inside of the loop.

The fixing device 34 forms a fixing nip by means of a fixing roller 34*a* containing a halogen lamp or other such heating source (not shown), and a pressing roller 34*b* that rotates while in contact with the fixing roller 34*a* at a specific pressure. Once the recording paper P that has been fed into the fixing device 34, the side supporting the unfixed toner image is pressed tightly against the fixing roller 34*a* and squeezed in the fixing nip. The effects of heating and pressing soften the toner in the toner image, which fixes the full-color image.

After being discharged from the fixing device 34, the recording paper P passes along a post-fixing conveyance path 35, and then comes to a branching point between a paper discharge path 36 and a pre-reversal conveyance path 41. A switching arm 42 that is rotationally driven around a rotational axis 42*a* is disposed to the side of the post-fixing conveyance path 35, and by its rotation either opens up or blocks off the area near the end of the post-fixing conveyance path 35. At the timing at which the recording paper P is fed out from the fixing device 34, the switching arm 42 stops at the rotation position indicated by the solid line in FIG. 1, and opens up the area near the end of the post-fixing conveyance path 35. This allows the recording paper P to advance from the post-fixing conveyance path 35 into the paper discharge path 36, where it is sandwiched between a pair of paper discharge rollers 37.

If a single-sided print mode has been set by input to a control component such as a keypad (not shown), a control signal sent from a personal computer (not shown), or the like, the recording paper P in between the paper discharge rollers 37 is discharged directly to outside the machine, and is stacked in a stacking component, which is the top face of a top cover 50 of the casing.

On the other hand, if a double-sided print mode has been set, once the rear end of the recording paper P, which has been conveyed into the paper discharge path 36 while the front end is sandwiched between the paper discharge rollers 37, has passed through the post-fixing conveyance path 35, the switching arm 42 rotates up to the position indicated by the broken line in FIG. 1, thereby blocking off the area near the end of the post-fixing conveyance path 35. At substantially the same time, the paper discharge rollers 37 begin to rotate backward. Now the recording paper P is conveyed with its rear end facing forward, and advances into the pre-reversal conveyance path 41.

FIG. 1 shows this printer from the front side. The near side (from the viewer's perspective) in the drawing is the front of the printer, and the far side is the back. The right side in the drawing is the right face, and the left is the left face. The right end of this printer is a reverse unit 40 that is can be opened and closed with respect to the casing by being rotated around a rotational shaft 40*a*. When the rotation of the paper discharge rollers 37 is reversed, the recording paper P advances into the pre-reversal conveyance path 41 of this reverse unit 40, and is conveyed from the top to the bottom side (in the vertical direction). After passing between a pair of reverse conveyance rollers 43, the paper advances into a reverse conveyance path 44 that curves in a semicircle. As the paper is conveyed along this curved shape, the top and bottom sides are reversed, while the advance direction from top to bottom in the vertical direction also reverses so that the paper is conveyed from bottom to top in the vertical direction. After this, the paper goes through the above-mentioned paper feed path 31 and again advances into the secondary transfer nip. A full-color image is secondarily transferred all at once onto the other side of the paper, after which the paper goes through the post-transfer conveyance path 33, the fixing device 34, the post-fixing conveyance path 35, the paper discharge path 36, and the paper discharge rollers 37, in that order, before being discharged to outside the machine.

The above-mentioned reverse unit 40 has an external cover 45 and a swing member 46. More specifically, the external cover 45 of the reverse unit 40 is supported such that it rotates around the rotational shaft 40*a* provided to the casing of the printer. This rotation causes the external cover 45 to open and close with respect to the casing along with the swing member 46 supported on the inside of this cover. As indicated by the broken lines, when the external cover 45 opens along with the swing member 46 on its inside, the paper feed path 31, the secondary transfer nip, the post-transfer conveyance path 33, the fixing nip, the post-fixing conveyance path 35, and the paper discharge path 36 formed between the reverse unit 40 and the main part of the printer are split in two longitudinally and exposed to the outside. This allows pap jams to be easily cleared from inside the paper feed path 31, the secondary transfer nip, the post-transfer conveyance path 33, the fixing nip, the post-fixing conveyance path 35, and the paper discharge path 36.

Also, when the external cover 45 is open, the swing member 46 is supported by the external cover 45 such that it rotates around a swing shaft (not shown) provided to the external cover 45. As a result of this rotation, when the swing member 46 is opened with respect to the external cover 45, the pre-reversal conveyance path 41 and the reverse conveyance path 44 are split in two longitudinally and exposed to the outside. As a result, paper jams can be easily cleared from inside the pre-reversal conveyance path 41 or inside the reverse conveyance path 44.

As indicated by the arrow in the drawing, a top cover 50 of the printer casing is supported rotatably around a rotational shaft 51, and when rotated in the counter-clockwise direction in the drawing, it is opened with respect to the casing. The top opening of the casing is largely exposed toward the outside. This exposes an optical writing unit 71.

A system in which toner images are superposed by a plurality of process units 1Y, 1M, 1C, and 1K arranged in a straight line, as is the case with this printer, is called a tandem system. With a tandem printer, the overall size of the apparatus tends to be larger in the direction in which the process units are arranged. In view of this, with this printer, the amount of space taken up in the direction of unit arrangement is suppressed by forming the hoppers, which account for a particularly large amount of space in the process units, in a shape that extends longer in the direction perpendicular to the unit arrangement direction. When this is done, however, it is more difficult to employ a configuration in which the toner inside the hopper drops into the supply component under its own weight. Also, with this configuration, toner works its way into the gap between the supply roller 10K shown in FIG. 2, for example, and the opposing side wall 14K that opposes this roller, and this tends to result in the formation of an aggregated block of toner.

Next, the characteristic configuration of this printer will be described.

In FIG. 2, the supply component 7K has an opposing side wall 14K that opposes the peripheral face of the supply roller 10K with a specific gap in between, and this opposing side wall 14K supports a canopy member 70K in cantilever fashion. The canopy member 70K is located directly above the gap between the supply roller 10K and the opposing side wall 14K, and impedes the advance into the gap of the toner that drops through the communication opening 9K into the supply component 7K and is deposited on the supply roller 10K. This minimizes an increase in pressure on the toner within the gap, and makes it less likely that an aggregated block of toner will form. Also, the increase in torque of the supply roller 10K, unevenness of image density, and wear to the supply roller 10K caused by the formation of an aggregated block of toner in the gap are suppressed.

The result of a configuration in which the canopy member 70K (serving as the advance impeding member) supports the opposing side wall 14K in cantilever fashion is that the canopy member 70K and the supply component 7K can be integrally molded, which helps lower the cost.

The closest distance between the canopy member 70K and the supply roller 10K is set to be greater than 0 mm and less than 5 mm. The reason for this is described as follows. When the canopy member 70K and the supply roller 10K are in contact (closest distance=0 mm), any toner residing in the gap between the supply roller 10K and the opposing side wall 14K will be supported on the surface of the supply roller 10K, and even if it attempts to come out of the gap as the roller rotates, it will be scraped off by the canopy member 70K. Accordingly, the toner is not discharged from the above-mentioned gap as the supply roller 10K rotates, the toner pressure within the gap gradually rises, and this leads to toner aggregation. Also, experiments conducted by the inventors have revealed that, as shown in FIG. 3, if the above-mentioned closest distance is set to 5 mm or more, the toner on the supply roller 10K will move gravitationally and advance from between the canopy member 70K and the supply roller 10K toward the above-mentioned gap, and this will lead to toner aggregation. Toner aggregation within the gap can be effectively suppressed by keeping the closest distance to less than 5 mm.

As shown in the drawing, the canopy member 70K has a curved face, whose radius of curvature matches the peripheral face of the supply roller 10K, on the side opposite the supply roller 10K. Using a canopy member 70K with this configuration reduces the amount of wasted space formed between the supply roller 10K and the canopy member 70K.

Figure 4:
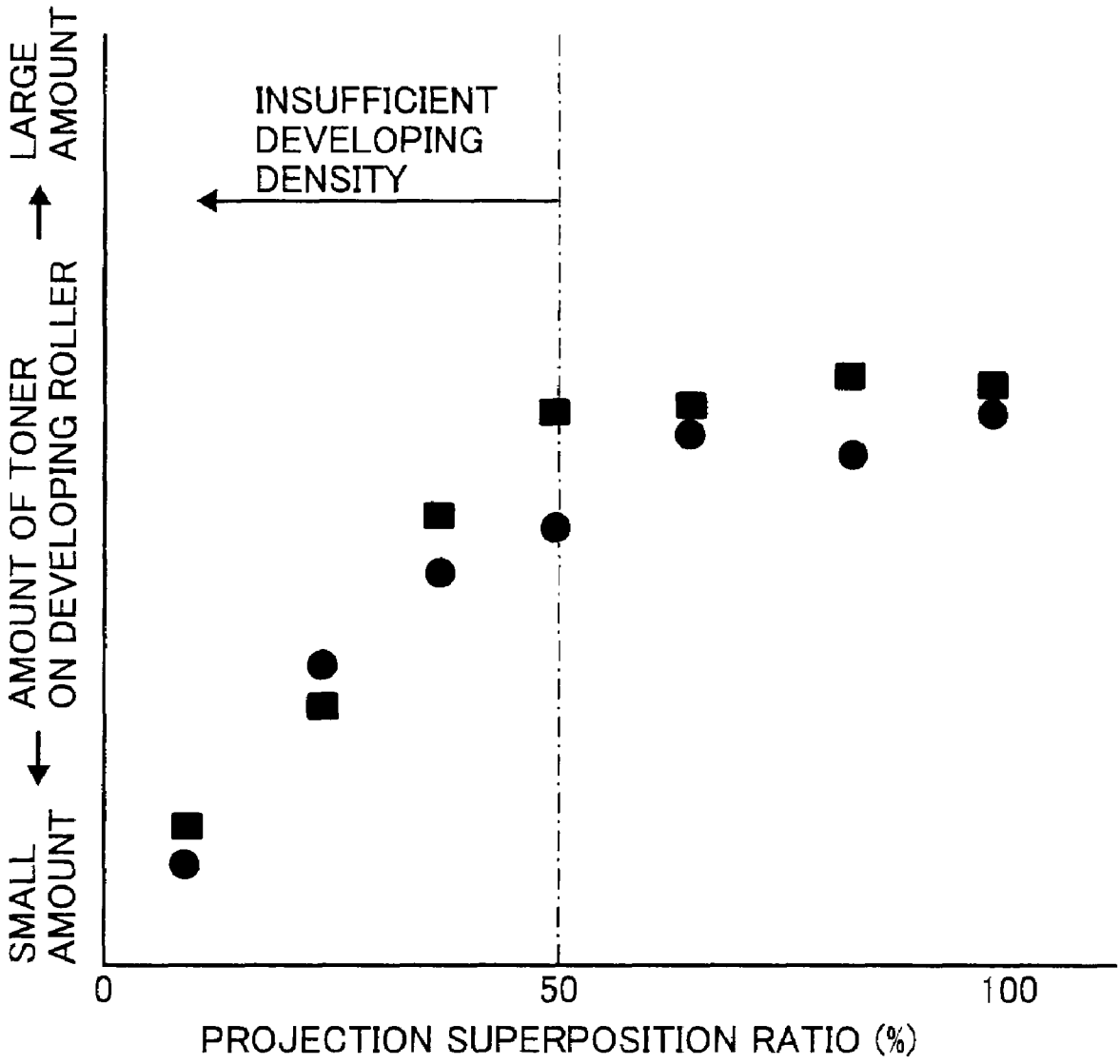
FIG. 4 is a graph of the relationship between the amount of toner on a developing roller and the projected superposition ratio.

The inventors prepared a plurality of canopy members 70K of different sizes and exchanged them one after the other to change the projected superposition ratio, which was the superposition ratio of a projection plane in the vertical direction of the canopy member 70K versus a projection plane in the vertical direction of the supply roller 10K. The developing device was then driven at various projection superposition ratios, and the amount of toner was measured per unit of surface area on the surface of the developing roller 11K immediately after passing the point of contact with the thinning blade 12K. These results are shown as a graph in FIG. 4. In this graph, v1 is the linear velocity of the developing roller 11K, and v2 is the linear velocity of the supply roller 10K. The region to the left of the one-dot chain line in the graph is where developing density was insufficient due to insufficient supply of toner from the developing roller 11K to the photoconductive member 2K. Thus, to minimize the occurrence of insufficient developing density, it was found that the projection plane in the vertical direction of the canopy member 70K must be superposed with a region that is less than half of the projection plane in the vertical direction of the supply roller 10K.

In view of this, with this printer, the projection plane in the vertical direction of the canopy member 70K is superposed with a region that is less than half the projection plane in the vertical direction of the supply roller 10K. With this configuration, a sufficient amount of toner that drops through the communication opening 9K into the supply component 7K is brought into contact with the supply roller 10K, allowing an image of sufficient density to be obtained.

With this printer, toner with the following characteristics is held within the hopper 6K. This toner is composed of a plurality of toner particles containing wax, and the volumetric average size of these toner particles is from 6 to 10 μm. Also, this is a nonmagnetic toner whose maximum tensile strength, as measured with an Aggrobot made by Hosokawa Micron, is less than 0.55 N. Using a toner composed of particles containing wax allows oilless fixing to be accomplished at a low heating temperature. The inventors also discovered experimentally that if the measured maximum tensile strength of the toner is 0.55 N or higher, the toner will suddenly begin to be prone to aggregation in the above-mentioned gap. Thus, using a toner whose measured maximum tensile strength is less than 0.55 N allows the formation of an aggregated block of toner within the gap to be suppressed more effectively.

The configuration of the K-use developing device 5K was described through reference to FIG. 2, but the Y, C, and M-use developing devices also have the same configuration.

Figure 5:
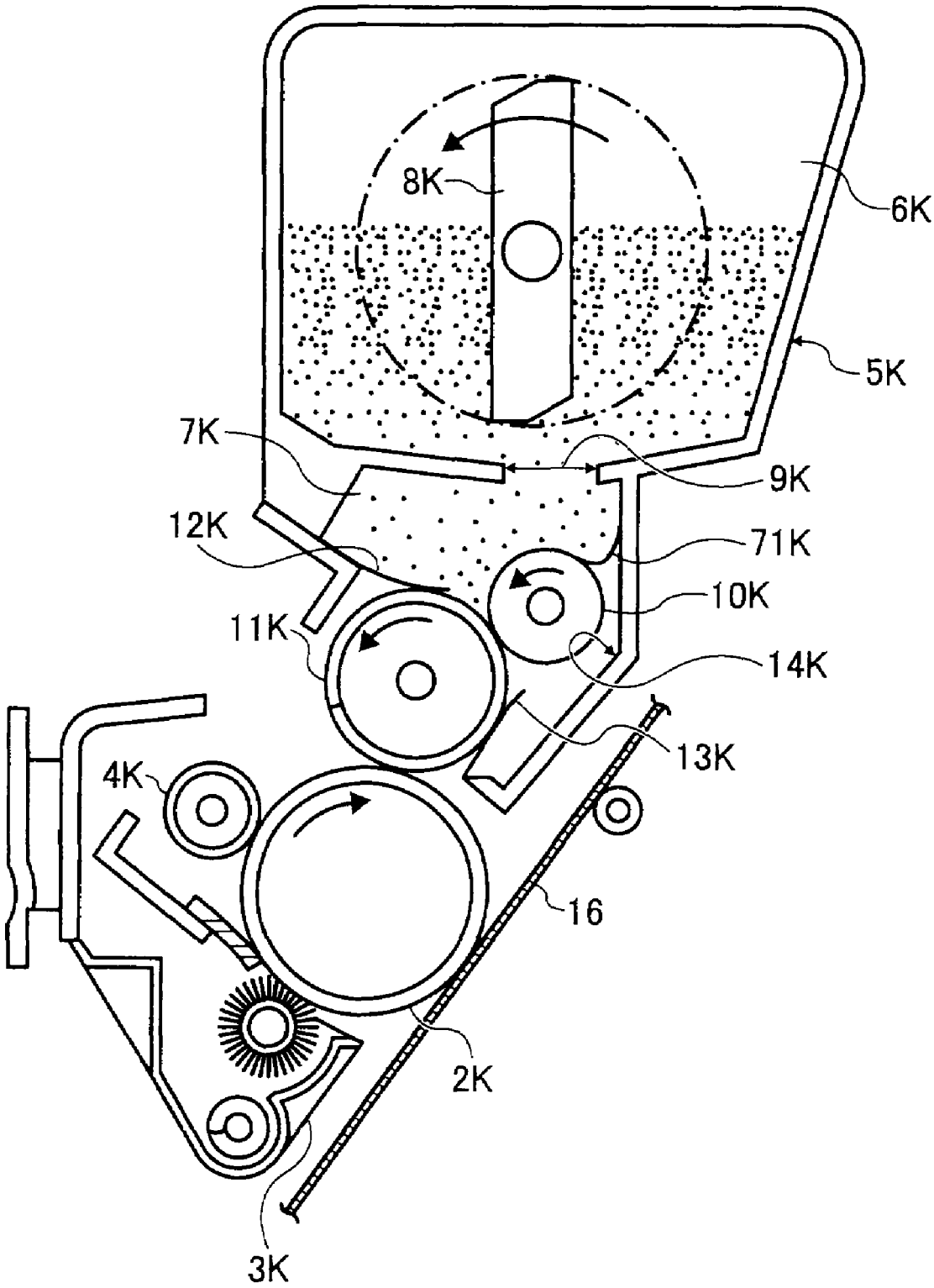
FIG. 5 is a diagram of the structure of an apparatus pertaining to a first modification of the same process unit.

FIG. 5 shows an apparatus pertaining to a first modification example of the process unit 1K in this printer. With the developing device 5K of the apparatus in this first modification example, a flexible film member 71K that is cantilevered on the opposing side wall 14K is used as the advance impeding member. The film member 71K can be easily attached to the opposing side wall 14K by adhesive bonding, adhesive tape, or the like. Thus, an advance impeding member can be realized at a lower cost than when something that has to be fixed with a screw is used as the advance impeding member.

The free end of the film member 71K is in contact with the supply roller 10K from above. With this configuration, the gap between the supply roller 10K and the opposing side wall 14K is blocked from above by the film member 71K, and this prevents the toner from advancing into the gap.

Also, the film member 71K is composed of a material whose frictional charge polarity is of the opposite polarity from the frictional charge polarity of the developer. Examples include urethane resins, acrylic resins, and nylon resins. With this configuration, as the film member 71K and the toner on the supply roller 10K are rubbed together by the rotation of the supply roller 10K, the toner is favorably charged, and this suppresses fouling due to insufficient charging of the toner. This fouling occurs when toner adheres to the background part of the photoconductive member.

Figure 6:
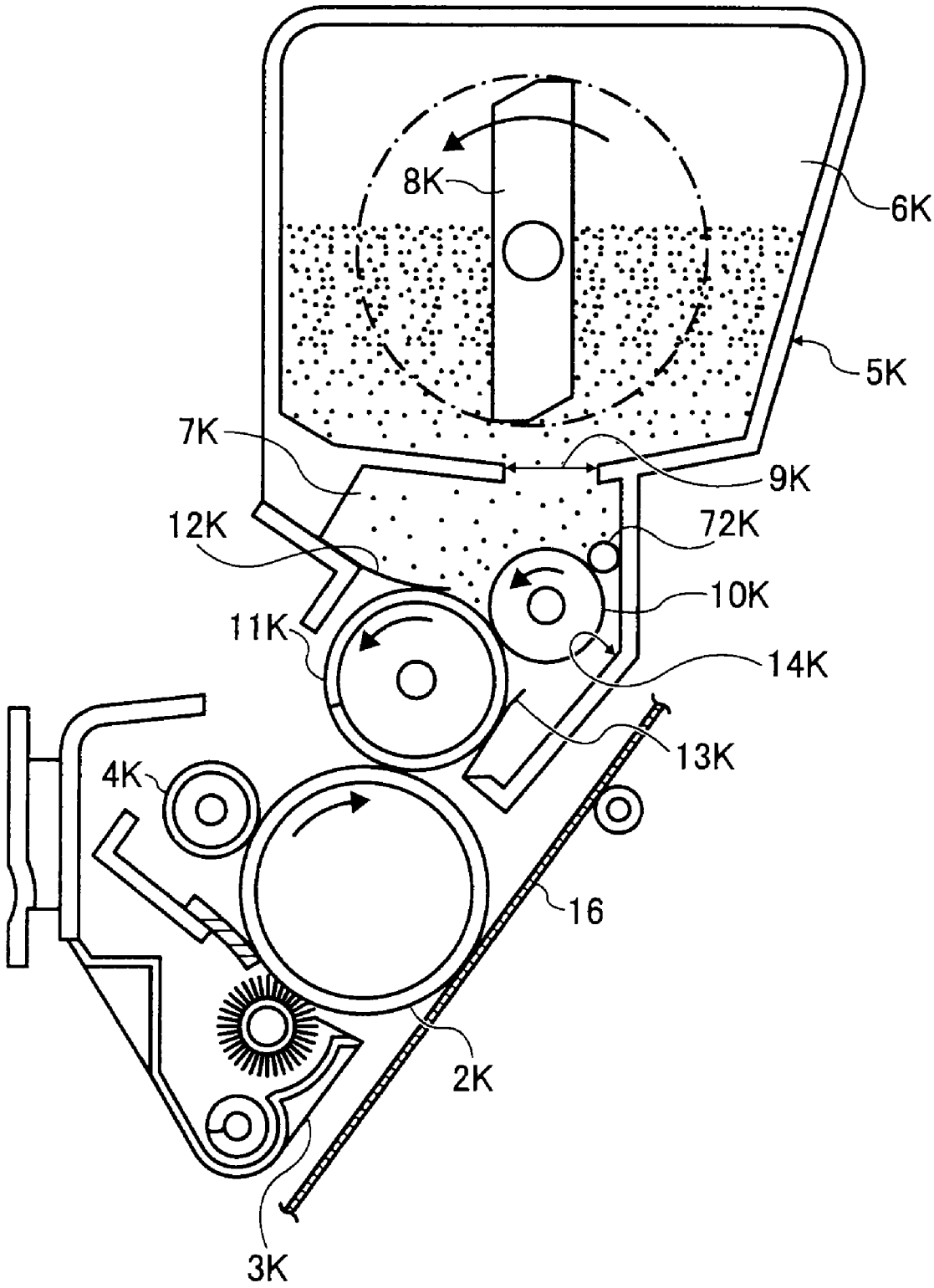
FIG. 6 is a diagram of the structure of an apparatus pertaining to a second modification of the same process unit.

FIG. 6 shows an apparatus pertaining to a second modification example of the process unit 1K in this printer. With the developing device 5K of the apparatus in this second modification example, an advance impeding roller 72K (serving as the advance impeding rotary member) capable of rotation around an axis parallel to the rotational axis of the supply roller 10K is used as the advance impeding member. The advance impeding roller 72K is composed of a brush roller with countless bristles embedded in a core, a roller comprising a core covered with an elastic layer, or the like, and is disposed so as to be in contact with the opposing side wall 14K. With this configuration, the advance of toner into the gap can be impeded better than when the advance impeding roller 72K does not come into contact with the opposing side wall.

The advance impeding roller 72K is rotationally driven in the clockwise direction in the drawing by a drive means (not shown) so as to move the side wall opposing the supply roller 10K in the same direction as the surface of the supply roller 10K. With this configuration, any toner that advances into the gap is sandwiched between the advance impeding roller 72K and the supply roller 10K, whose surfaces are moving in the same direction, and is forcibly discharged out of the gap.

Up to now the description has been of a printer that uses a plurality of process units to form a multicolor toner image, but the present invention can also be applied to an image forming apparatus equipped with just one photoconductive member.

With the printer pertaining to this embodiment, since the canopy member 70K, which serves as the advance impeding member, is supported in cantilever fashion on the opposing side wall 14K, the canopy member 70K and the supply component 7K can be molded integrally, which lowers the cost.

Also, since the flexible canopy member 71K is used as the advance impeding member with the apparatus in the first modification example, the cost is lower than when fastening with a screw is required, as mentioned above.

Also, since the free end of the film member 71K comes into contact from above with the supply roller 10K (serving as the developer supply member), the gap between the supply roller 10K and the opposing side wall 14K can be blocked off from above, and the toner can be prevented from advancing into the gap.

Also, since the film member 71K is composed of a material whose frictional charge polarity is of the opposite polarity from the frictional charge polarity of the developer, as the film member 71K and the toner on the supply roller 10K are rubbed together, the toner is favorably charged, and this suppresses fouling due to insufficient charging of the toner.

Also, with the apparatus of the second modification example, since the advance impeding roller 72K (serving as the advance impeding rotary member), which is capable of rotation around an axis parallel to the rotational axis of the supply roller 10K, is used as the advance impeding member, the behavior of the toner near the advance impeding roller 72K can be controlled by rotationally driving this roller as needed.

Also, since the advance impeding roller 72K is in contact with the opposing side wall 14K, the advance of toner into the gap can be suppressed better than when there is no contact.

Also, a drive means (not shown) is provided for rotationally driving the advance impeding rotary roller in the clockwise direction in the drawing so as to move the side wall opposing the supply roller 10K in the same direction as the surface of the supply roller 10K. With this configuration, any toner that advances into the gap is sandwiched between the advance impeding roller 72K and the supply roller 10K, whose surfaces are moving in the same direction, and is forcibly discharged out of the gap.

Also, with the printer pertaining to this embodiment, since the projection plane in the vertical direction of the canopy member 70K is superposed with a region that is less than half the projection plane in the vertical direction of the supply roller 10K, a sufficient amount of toner that drops through the communication opening 9K into the supply component 7K is brought into contact with the supply roller 10K, allowing an image of sufficient density to be obtained.

Also, since the closest distance between the canopy member 70K and the supply roller 10K is set to be greater than 0 mm and less than 5 mm, a situation is avoided in which toner aggregation occurs as a result of toner discharge from the gap between the supply roller 10K and the canopy member 70K being impeded, as discussed above, and the occurrence of toner aggregation as a result of the toner that has come between the supply roller 10K and the canopy member 70K advancing into the above-mentioned gap can be more effectively suppressed.

The following effects are obtained with the present invention.

(1) By disposing the second holding chamber over the first holding chamber, the overall developing device can have a taller shape, so the device is smaller in size than when a tandem system is employed.

(2) The advance of the developer deposited on the developer supply member into the gap between the developer supply member and the opposing side wall of the first holding chamber is impeded by an advance impeding member provided directly over the gap. This suppresses an increase in pressure on the developer inside the gap, which makes it less likely that the developer will form an aggregated block. Thus, the increase in torque of the developer supply member, unevenness of image density, and wear to the developer supply member caused by the formation of an aggregated block of developer in the gap can be suppressed.

Various modifications will become possible for those skilled in the art after receiving the teachings of the present disclosure without departing from the scope thereof.

What is claimed is:

1. A developing device, comprising:

a developer support member configured to develop a latent image supported on a latent image support with a developer supported on a surface of the developer support member;

a first holding chamber configured to hold a developer to be supplied to the developer support member;

a developer supply member configured to supply the developer supported on a peripheral face thereof to the developer support member due to rotation within the first holding chamber;

a second holding chamber, disposed above the first holding chamber, configured to hold a developer that replenishes the first holding chamber;

a communication opening provided between the two chambers configured to allow the developer inside the second holding chamber to drop down into the first holding chamber;

an opposing side wall that extends from a location where the developer is supplied to the developer supply member, to a location adjacent the peripheral face of the developer supply member, to a location where the developer that has dropped through the communication opening into the first holding chamber is supplied to the developer support member by the developer supply member, wherein the opposing side wall opposes, via a predetermined gap, at least a region between a portion of the peripheral face of the developer supply member that faces the communication opening and a portion of the peripheral face of the developer supply member that contacts the developer support member; and an advance impeding member configured to impede the advance of the developer, that has dropped through the communication opening into the first holding chamber, into the predetermined gap, wherein the advance impeding member spans the predetermined gap from the opposing side wall to the developer supply member.

2. The developing device according to claim 1, wherein the advance impeding member is cantilevered on the opposing side wall.

3. The developing device according to claim 2, wherein a flexible film member is used as the advance impeding member.

4. The developing device according to claim 3, wherein a free end of the film member is in contact with the developer supply member from above.

5. The developing device according to claim 4, wherein the film member is composed of a material whose frictional charge polarity is of the opposite polarity from the frictional charge polarity of the developer.

6. The developing device according to claim 1, wherein the advance impeding member is an advance impeding rotary member capable of rotation around an axis parallel to a rotational axis of the developer supply member.

7. The developing device according to claim 6, further comprising a drive unit configured to rotationally drive the advance impeding rotary member such that the face opposing the developer supply member is moved in the same direction as the surface of the developer supply member.

8. The developing device according to claim 1, wherein a roller member whose surface is composed of an elastic foamed material is used as the developer supply member.

9. An image forming apparatus, comprising:

a latent image support configured to support a latent image; and developing device configured to develop the latent image on the latent image support, wherein the developing device includes a developer support member configured to develop a latent image supported on a latent image support with a developer supported on a surface of the developer support member;

a first holding chamber configured to hold a developer to be supplied to the developer support member;

a developer supply member configured to supply the developer supported on a peripheral face thereof to the developer support member due to rotation within the first holding chamber;

a second holding chamber, disposed above the first holding chamber, configured to hold a developer that replenishes the first holding chamber;

a communication opening provided between the two chambers configured to allow the developer inside the second holding chamber to drop down into the first holding chamber;

an opposing side wall that extends from a location where the developer is supplied to the developer supply member, to a location adjacent the peripheral face of the developer supply member, to a location where the developer that has dropped through the communication opening into the first holding chamber is supplied to the developer support member by the developer supply member, wherein the opposing side wall opposes, via a predetermined gap, at least a region between a portion of the peripheral face of the developer supply member that faces the communication opening and a portion of the peripheral face of the developer supply member that contacts the developer support member; and an advance impeding member configured to impede the advance of the developer, that has dropped through the communication opening into the first holding chamber, into the predetermined gap, wherein the advance impeding member spans the predetermined gap from the opposing side wall to the developer supply member.

10. A developing method, comprising the steps of:

rotating a developer supply member opposing, via a predetermined gap, any one of a plurality of opposing side walls in a first holding chamber configured to hold a developer to be supplied to a developer support member, and thereby supplying the developer from the developer supply member to the developer support member;

using the developer supported on the surface of the developer support member to develop a latent image supported on a latent image support;

dropping the developer held in a second holding chamber disposed above the first holding chamber, through a communication opening between the second holding chamber and the first holding chamber, toward the developer supply member in the first holding chamber, and thereby replenishing the first holding chamber with the developer; and providing as the first holding chamber an opposing side wall that extends from a location where the developer is supplied to the developer supply member, to a location adjacent the peripheral face of the developer supply member, to a location where the developer that has dropped through the communication opening into the first holding chamber is supplied to the developer support member by the developer supply member, wherein the opposing sidewall opposes, via a predetermined gap, at least the region between a portion of the peripheral face of the developer supply member that faces the communication opening and a portion of the peripheral face of the developer supply member that contacts the developer support member; and impeding the advance, into the predetermined gap, of the developer that drops through the communication opening toward the developer supply member, with an advance impeding member provided directly above the predetermined gap.

11. The developing method according to claim 10, wherein a toner composed of a plurality of toner particles containing wax is used as the developer.

12. The developing method according to claim 11, wherein the toner is one whose maximum tensile strength is less than 0.55 N.

13. A developing device, comprising:

a developer support member configured to develop a latent image supported on a latent image support with a developer supported on a surface of the developer support member;

a first holding chamber configured to hold a developer to be supplied to the developer support member;

a developer supply member configured to supply the developer supported on a peripheral face thereof to the developer support member due to rotation within the first holding chamber;

a second holding chamber, disposed above the first holding chamber, configured to hold a developer that replenishes the first holding chamber;

a communication opening provided between the two chambers configured to allow the developer inside the second holding chamber to drop down into the first holding chamber;

an opposing side wall that extends from a location where the developer is supplied to the developer supply member, to a location adjacent the peripheral face of the developer supply member, to a location where the developer that has dropped through the communication opening into the first holding chamber is supplied to the developer support member by the developer supply member, wherein the opposing side wall opposes, via a predetermined gap, at least a region between a portion of the peripheral face of the developer supply member that faces the communication opening and a portion of the peripheral face of the developer supply member that contacts the developer support member; and an advance impeding member configured to impede the advance of the developer, that has dropped through the communication opening into the first holding chamber, into the predetermined gap, wherein the advance impeding member is cantilevered on the opposing side wall, and wherein a flexible film member is used as the advance impeding member.

14. The developing device according to claim 13, wherein a free end of the film member is in contact with the developer supply member from above.

15. The developing device according to claim 14, wherein the film member is composed of a material whose frictional charge polarity is of the opposite polarity from the frictional charge polarity of the developer.

16. A developing device, comprising:

a developer support member configured to develop a latent image supported on a latent image support with a developer supported on a surface of the developer support member;

a first holding chamber configured to hold a developer to be supplied to the developer support member;

a developer supply member configured to supply the developer supported on a peripheral face thereof to the developer support member due to rotation within the first holding chamber;

a second holding chamber, disposed above the first holding chamber, configured to hold a developer that replenishes the first holding chamber;

a communication opening provided between the two chambers configured to allow the developer inside the second holding chamber to drop down into the first holding chamber;

an opposing side wall that extends from a location where the developer is supplied to the developer supply member, to a location adjacent the peripheral face of the developer supply member, to a location where the developer that has dropped through the communication opening into the first holding chamber is supplied to the developer support member by the developer supply member, wherein the opposing side wall opposes, via a predetermined gap, at least a region between a portion of the peripheral face of the developer supply member that faces the communication opening and a portion of the peripheral face of the developer supply member that contacts the developer support member; and an advance impeding member configured to impede the advance of the developer, that has dropped through the communication opening into the first holding chamber, into the predetermined gap, wherein the advance impeding member is a canopy member that includes a flat portion that extends perpendicular from the opposing sidewall such that the canopy portion is parallel with the communication opening.

17. The developing device according to claim 16, wherein a projection plane in a vertical direction of the advance impeding member is superposed with less than half the area of a projection plane in a vertical direction of the developer supply member.

18. The developing device according to claim 16, wherein the closest distance between the developer supply member and the advance impeding member is greater than 0 mm and less than 5 mm.

* * * * *